United States Patent [19]

Rafford et al.

[11] Patent Number: 4,793,321

[45] Date of Patent: Dec. 27, 1988

[54] SELF-PRIMING ALCOHOL STOVE

[75] Inventors: Charles R. Rafford; Walter Hoehn, both of Clinton, Conn.

[73] Assignee: International Marine Industries, Inc., Stamford, Conn.

[21] Appl. No.: 43,436

[22] Filed: Apr. 28, 1987

[51] Int. Cl.[4] ..... F24C 5/04; F24C 5/02

[52] U.S. Cl. ..... 126/43; 126/44; 126/45; 431/205; 431/206

[58] Field of Search ..... 126/43, 44, 45; 431/205, 206, 243

[56] References Cited

U.S. PATENT DOCUMENTS

| | | | |
|---|---|---|---|
| 466,867 | 1/1892 | Wojidkow . | |
| 599,147 | 2/1898 | Manning et al. . | |
| 1,036,523 | 8/1912 | Lange . | |
| 1,130,501 | 3/1915 | Erichsen . | |
| 1,249,165 | 10/1917 | Kin-Chao . | |
| 3,316,957 | 9/1965 | Stockli et al. . | |
| 3,606,609 | 12/1969 | Lipper et al. . | |
| 4,170,981 | 10/1979 | Hakata et al. | 126/43 |
| 4,416,617 | 11/1983 | Ebbeson . | |

FOREIGN PATENT DOCUMENTS

| | | | |
|---|---|---|---|
| 13022 | 3/1910 | Denmark | 126/43 |
| 50503 | 5/1911 | Fed. Rep. of Germany | 431/205 |
| 321163 | 3/1902 | France | 126/43 |
| 434694 | 2/1912 | France | 126/43 |
| 482814 | 4/1917 | France | 126/43 |
| 68511 | 5/1980 | Japan | 431/243 |
| 45810 | 2/1918 | Sweden | 431/206 |
| 134338 | 1/1952 | Sweden | 126/43 |
| 147264 | 10/1954 | Sweden | 431/205 |
| 5779 | of 1886 | United Kingdom | 431/206 |

*Primary Examiner*—Larry Jones
*Assistant Examiner*—Carl D. Price
*Attorney, Agent, or Firm*—St. Onge Steward Johnston & Reens

[57] ABSTRACT

The present invention is drawn to a self-priming alcohol stove comprising a burner cup with a base and side walls for storage of liquid alcohol, a main burner attached to the burner cup, a start-up burner, and a heat transfer unit to transfer heat from the main burner and/or the start-up burner to a quantity of alcohol held by transfer unit within the burner cup at a location distal from the side walls and the base. The vaporized alcohol passes to the main burner and is ignited by flames from the start-up burner. More alcohol is then continuously absorbed from the burner cup by the wick between the concentric, cylindrical walls to maintain the main burner flame. Operation of the main burner substantially deprives the start-up burner of oxygen so that heat from the main burner vaporizes alcohol absorbed between the concentric walls. Excessive evaporation of alcohol in the burner cup is precluded by a metallic cooling disc which is kept at low temperature by its conduction contact with the side walls and/or base of the metallic burner cup.

20 Claims, 2 Drawing Sheets

SELF-PRIMING ALCOHOL STOVE

BACKGROUND OF THE INVENTION

Alcohol burning stoves conventionally have a burner cup with absorptive wadding immersed in a supply of liquid alcohol and a main burner assembly which is ignited to produce a flame maintained by consumption of alcohol in the burner cup. For many years, outdoorsmen have used such alcohol stoves for cooking on boats or at campsites where supplies of natural gas are unavailable. In addition, alcohol stoves have been utilized by homemakers in conjunction with fondue cookers and chafing dishes placed on serving tables, dining tables, or other locations away from kitchen stoves. Examples of such alcohol stoves are disclosed by U.S. Pat. No. 466,867 to Wojidkow, U.S. Pat. No. 599,147 to Manning, et al., U.S. Pat. No. 1,036,523 to Lange, U.S. Pat. No. 1,130,501 to Erichsen, U.S. Pat. No. 3,316,957 to Stokli, et al., U.S. Pat. No. 3,606,609 to Lipper, et al., and British Patent No. 1,249,165 to Kin Hip Metal & Plastic Factory Limited.

Despite the long-standing use of alcohol stoves in the form commonly employed as fondue cookers, their operation has not been totally satisfactory due to fluctuations in flame intensity, inefficient burning due to poor alcohol-air mixing, low fuel capacity, and a relatively low maximum flame output. At start-up, the alcohol which is poured into a stove cup tends to be cold, and, as a result, relatively little alcohol evaporates. Because alcohol evaporation is needed to fuel the stove's main burner, it is often necessary to provide the stove with a start-up burner which, when ignited, warms the alcohol in the burner cup until there is sufficient alcohol evaporation to fuel the main burner. Once sufficient alcohol evaporation occurs, the main burner may be ignited. As the main burner continues burning alcohol, the stove gets progressively warmer, causing excessive alcohol evaporation and consequent high flame intensity. To control the size of the flames, a top can be placed completely or partially over the cup. Alternatively, burning can be controlled by providng the cup with a perforated nozzle extending upwardly from the cup to mix efficiently air and fuel.

One solution to these problems has been to provide a separate, alcohol tank from which alcohol can be dispensed in a controlled manner. In such systems, alcohol must be conveyed to the burner by gas pressurization of the tank or be elevating the tank to effect gravity flow of alcohol to the burner. Alcohol is heated to vaporization when it approaches or enters the burner. During operation, the vaporized alcohol mixes with air at the burner to achieve combustion. Start-up necessitates preheating the burner to effect vaporization. Although such stoves achieve higher output, greater efficiency, and better control than fondue cookers; stoves with separate burners and tanks are costly, complex, bulky, and difficult to start-up.

U.S. Pat. No. 4,416,617 to Ebbeson discloses another type of alcohol stove which has been used on boats for cooking. This device is constructed somewhat like a fondue cooker but is rather large to achieve adequate heating and is provided with a nozzle to reduce flame diameter and to achieve some mixing with air. The Ebbeson stove still has the disadvantages of somewhat inefficient combustion and difficult start-up.

SUMMARY OF THE INVENTION

The present invention is drawn to a self-priming alcohol stove which maintains a suitable flame intensity throughout its entire operation without storing alcohol in a distant reservoir.

The alcohol stove of the present invention comprises a burner cup having a base and side walls for storage of liquid alcohol, a main burner attached to the burner cup for consumption of alcohol in the cup when ignited, a start-up burner, and a heat transfer unit to transfer heat from the main burner and/or the start-up burner to a quantity of alcohol held by the heat transfer unit within the burner cup at a location distant from the side walls and base. A top plate is also provided with a lower surface attached to the burner cup and an upper surface containing the main burner. The main burner has an annular ring with holes through which alcohol vapor from the burner cup escapes. The heat transfer unit includes two concentric, cylindrical walls extending downwardly from the top plate into the burner cup. These inner and outer concentric, cylindrical walls which extend from the inner and outer perimeters of the main burner, respectively, have a fibrous wick between them which absorbs alcohol from the burner cup. The start-up burner is a fibrous wick within the inner concenric, cylindrical wall at a level in the burner cup where it absorbs alcohol. In addition, a metallic cooling disc is provided in the metallic burner cup in contact with the side walls and base so that alcohol in the burner cup is effectively cooled by the cool ambient temperatures surrounding the alcohol stove.

In operation, the start-up burner wick which is saturated with alcohol is ignited to vaporize the alcohol in the wick between the inner and outer concentric, cylindrical walls. When this alcohol evaporates, it passes through the openings of the main burner and is ignited by flames from the start-up burner. More alcohol is then continuously absorbed from the burner cup by the wick between the concentric, cylindrical walls to maintain the main burner flame. Heat from the start-up burner and the main burner increases the rate of alcohol evaporation until the main burner flame has reached a suitable intensity. Because the main burner is positioned around and above the start-up burner, the main burner will substantially deprive the start-up burner of oxygen to the extent that the start-up burner flame diminishes in intensity. Heat from the main burner then maintains alcohol evaporation between the inner and outer concentric, cylindrical walls.

The alcohol stove of the present invention has a number of advantages over prior art stoves. The self-priming operation of the stove by which alcohol is continuously evaporated from start-up through steady state operation permits the consumer to utilize the stove with no manipulation other than the striking of a match. Once steady state operation is achieved, there is no need for the consumer to manipulate the stove, because heat is only transferred to a small quantity of alcohol between the inner and outer concentric, cylindrical walls. The bulk of the alcohol in the burner cup outside of the outer cylindrical wall is kept from substantially evaporating, because it contacts the relatively cool side walls and base of the metallic burner cup. Steady state flame intensity of also kept under control by cooling the bulk of the alcohol with the metallic disc which contacts the relatively cool surfaces of the metallic burner cup.

DETAILED DESCRIPTION OF THE INVENTION

DETAILED DESCRIPTION OF THE DRAWINGS

Figure 1:
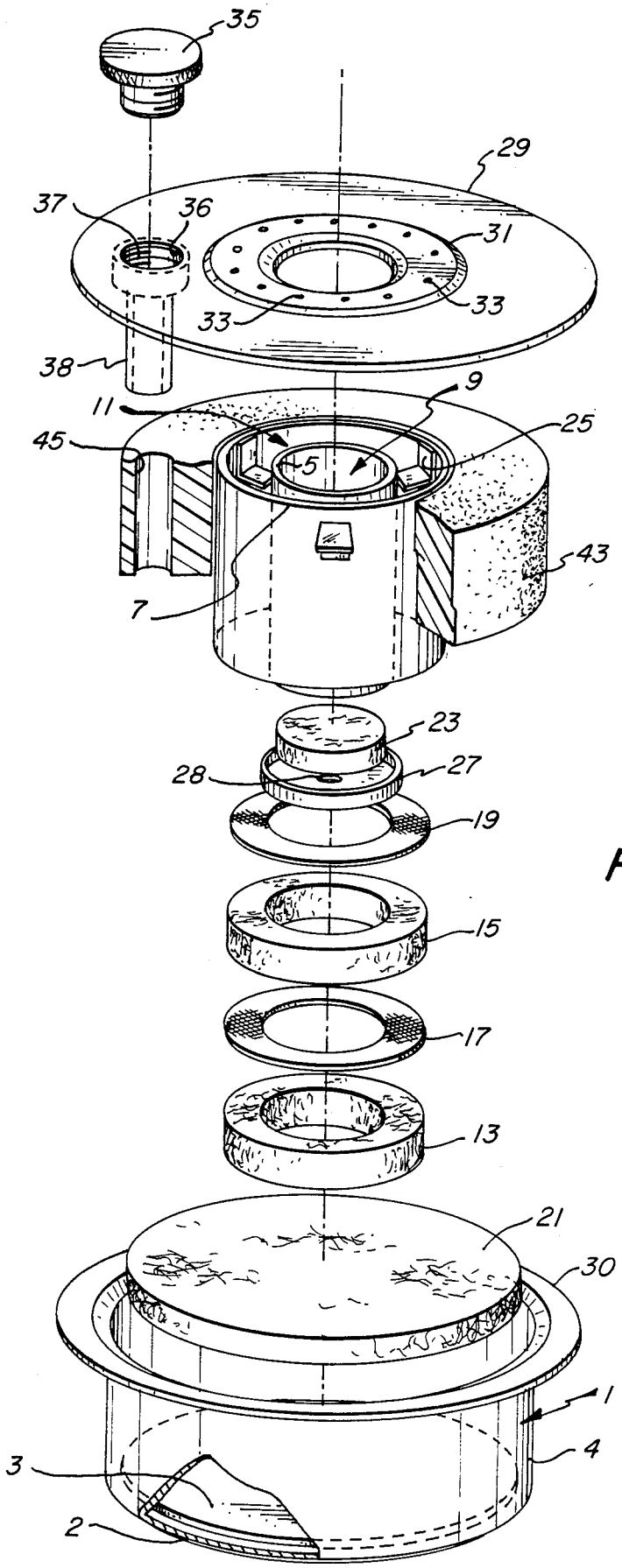
FIG. 1 is an exploded perspective view of an alcohol stove according to the present invention.

FIG. 1 is an exploded perspective view of an alcohol stove according to the present invention. The stove comprises a metallic burner cup 1 having a base 2 and side walls 4. The upper edge of the burner cup extends radially outward to form a lip 30. Inserted in a lower portion of the burner cup 1 is a metallic disc 3 on top of which a fibrous burner cup wick 21 is placed.

The alcohol stove of the present invention further includes a metallic top plate 29 on which a main burner assembly 31 with burner holes 33 is mounted. The top plate is further provided with a fill hole 36 through which alcohol is poured into the burner cup through fill tube 38. Fill hole 36 is sealed with a threaded fill plug 35 which can be screwed into threaded plug chamber 37.

Extending downwardly from top plate 29 in alignment with the inner and outer circumferences of main burner 31 are inner cylindrical wall 5 and outer cylindrical wall 7, respectively. These metallic walls define an inner chimney 9 and an outer chimney 11. A pair of inner tabs 25 are attached to the inner surface of outer wall 7 and extend radially inward toward the outer surface of inner wall 5 to maintain desired locations of screens 17 and 19 and wicks 13 and 15. Lower chimney wick 13, metallic lower chimney screen 17, upper chimney wick 15, and metallic upper chimney screen 19 are inserted in outer chimney 11 at a location where lower chimney wick 13 and upper chimney wick 15 can absorb alcohol in burner cup 1. Inner chimney wick 23 is held in wick cup 27 and placed within inner chimney 9 at a location where it can absorb alcohol from burner cup 1 through hole 28 in wick cup 27. Screens 17 and 19 contact inner wall 5 but not outer wall 7 to transfer heat from inner chimney 9 to outer chimney 11.

A foam ring 43 is placed within burner cup 1 around outer wall 7 and is provided with tubular cutout 45 to accommodate fill tube 38. Foam ring 43 is held in place by its close fitting relationship with outer wall 7, the sides of the burner cup 1, top plate 29, and fill tube 38.

Figure 2:
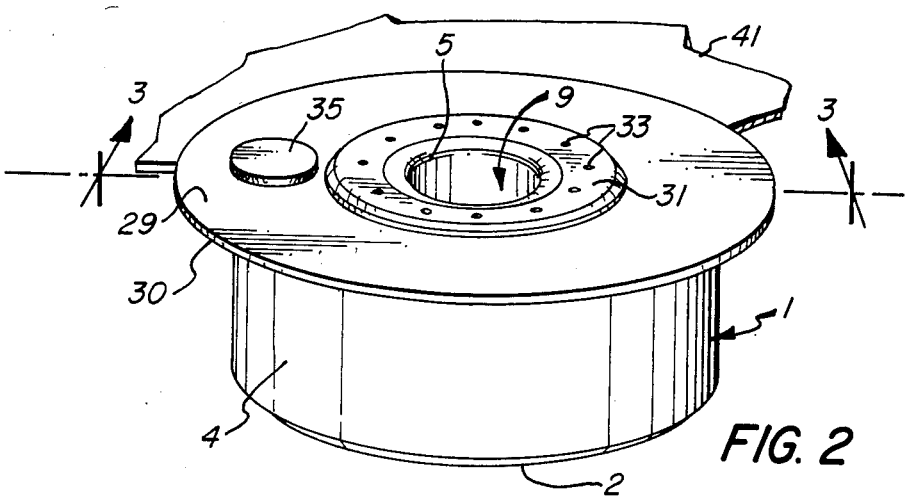
FIG. 2 is a perspective view of an assembled alcohol stove according to the present invention.

FIG. 2 is a perspective view of an assembled alcohol stove according to the present invention. As this figure illustrates, top plate 29 is attached to burner cup 1, while inner wall 5 is aligned with and sealed to the inner circumference of main burner assembly 31 so that inner chimney 9 is located within main burner assembly 31. In addition, top plate 29 is attached to burner cup 1 such that fill plug 35 and fill hole 36 are above the interior of burner cup 1. In its assembled state, the alcohol stove of the present invention is positioned in a mounting structure 41.

Figure 3:
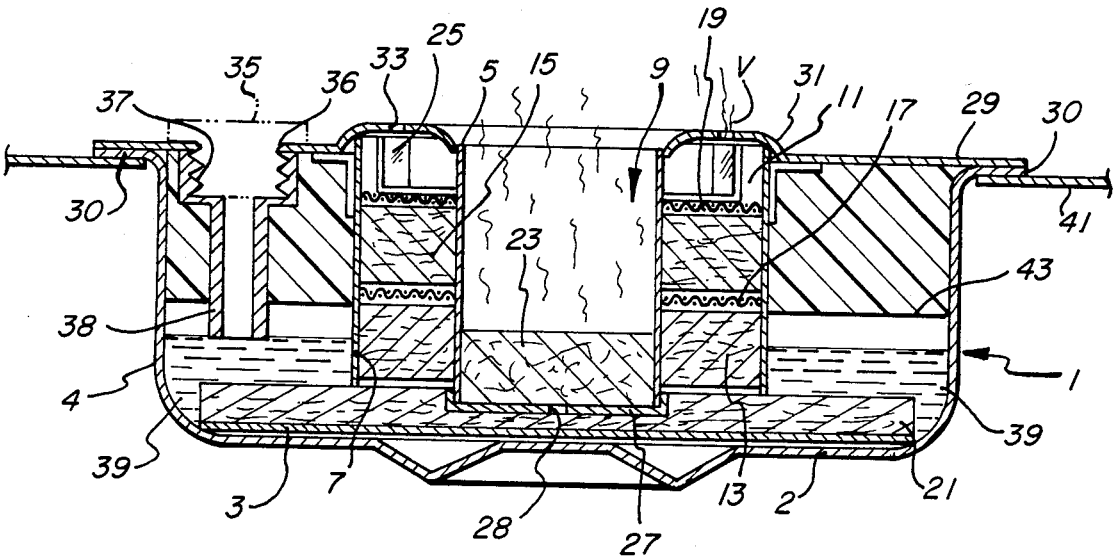
FIG. 3 is a cross sectional, side view of an assembled alcohol stove taken along line 2—2 of FIG. 2.

FIG. 3 is a cross sectional, side view of an assembled alcohol stove taken along line 3—3 of FIG. 2. As shown in FIG. 3, metallic disc 3 is placed within burner cup 1 so that it contacts base 2 and/or side walls 4 of burner cup 1 to conduct the cool ambient conditions outside of the burner cup into a central portion of alcohol 39. Burner cup wick 21 is on top of disc 3 and absorbs alcohol 39 with which it is in contact. Inner wall 5 extends downwardly into burner cup 1 to a point above metallic disc 3. Inner chimney wick 23 is inserted in inner chimney 9 at the lowest point of inner wall 5. As shown by FIG. 3, wick cup 27 which holds chimney wick 23 is around and against the lowest portion of inner wall 5. With this arrangement, inner chimney wick 23 absorbs alcohol from burner cup wick 21 (through hole 28 in wick cup 27) when the level of alcohol 39 drops below the lowest portion of inner chimney wick 23. Lower chimney wick 13 is positioned at the lowest point of outer wall 7 which extends downwardly toward metallic disc 3 to a point above the lowest point of inner wall 5. Lower chimney wick 13 contacts burner cup wick 21 so that it absorbs alcohol in the burner cup wick once the level of alcohol 39 in burner cup 1 drops below the lowest portion of lower chimney wick 13. In addition, lower chimney wick 13 and upper chimney wick 15 are flush against lower chimney screen 17 so that alcohol from lower chimney wick 13 is absorbed by upper chimney wick 15.

Inner tabs 25 are welded to the inner surface of outer wall 7 and have radially inwardly extending portions just above upper chimney screen 19. Inner wall 5 is welded at its highest point to top plate 29 along the inner circumference of main burner assembly 31. Outer wall 7 is not, however, welded to or in any way completely bonded to top plate 29.

Top plate 29 is welded to lip 30 of burner cup 1 to seal the alcohol stove of the present invention. Alcohol is then added through fill hole 36 by unscrewing fill plug 35 from plug chamber 37. Alcohol is poured into burner cup 1 through fill hole 36, plug chamber 37, and fill tube 38. During such filling, alcohol enters inner chimney 9 slowly, because hole 28 in wick cup 27 is quite small (0.04 to 0.06 inches in diameter) and restricts flow. During filling, the movement of air which must be displaced from within burner cup 1 to permit liquid addition is restricted by foam ring 43 which partially blocks passages between outer wall 7 and top plate 29. These passages would otherwise allow air in burner cup 1 around outer wall 7 to pass through burner holes 33. As a result, alcohol cannot fill burner cup 1 above the lowest point of fill tube 38 without waiting for the air to be slowly displaced. This ensures that burner cup 1 will not be overfilled with alcohol and, therefore, lessens the possibility of spillage when the stove is used on a boat which is prone to heel.

Foam ring 43 also has a pressure relief function. Since it only partially blocks the passage of gases between outer wall 7 and top plate 29 and through burner holes 33, foam ring 43 will allow gas (i.e. air and alcohol vapor) to vent through burner holes 33 when pressure builds within burner cup 1 as the stove heats up.

In its assembled state, the alcohol stove of the present invention is placed in a mounting structure 41 by resting the lower surface of lip 30 on the mounting structure.

Burner cup 1, disc 3, inner wall 5, outer wall 7, inner tabs 25, wick cup 27, top plate 29, and burner assembly 31 are preferably made from stainless steel. Lower chimney screen 17 and upper chimney screen 19 are preferably made from brass. Burner cup wick 21, lower chimney wick 13, upper chimney wick 15, and inner chimney wick 23 are preferably made from a fibrous ceramic material well known in the art. Foam ring 42 is made of a closed cell rubber foam.

In operation, the alcohol stove of the present invention is filled with alcohol by unscrewing fill plug 35 from plug chamber 37. Alcohol is then poured into burner cup 1 until it reaches a level substantially equal to the lowest point of fill tube 38, and fill plug 35 is then screwed into plug chamber 37.

Stove operation in initiated by lighting the alcohol in inner chimney wick 23 which functions as a start-up burner. Excessive alcohol saturation of inner chimney wick 23 is prevented by wick cup 27 which allows alcohol only slowly to enter inner chimney 9 through hole 28. The flame in the inner chimney 9 warms the alcohol absorbed in lower chimney wick 13 and upper chimney wick 15 by conduction of heat through inner wall 5, lower chimney screen 17, and upper chimney screen 19. After being sufficiently warmed, the alcohol is outer chimney 11 evaporates causing vapors to pass upwardly within outer chimney 11 and through main burner holes 33. The flame within inner chimney 9 ignites these vapors thereby starting main burner assembly 31. More alcohol is then continuously absorbed from burner cup wick 21 by lower chimney wick 13 and upper chimney wick 15 to maintain the main burner assembly flame. As heat from main burner assembly 31 and inner chimney 9 is conducted through inner wall 5, lower chimney screen 17, and upper chimney screen 19, the rate of alcohol evaporation within outer chimney 9 increases thereby intensifying the main burner assembly flame. Eventually, operation of main burner assembly 31 substantially deprives inner chimney 9 of oxygen by virtue of the main burner assembly's location above and around the inner chimney. Such oxygen deprivation causes the intensity of the flame in inner chimney 9 to be diminished in intensity. Alcohol evaporation within outer chimney 11 then proceeds at least mainly by virtue of heat conduction from main burner assembly 31 through inner wall 5, outer wall 7, lower chimney screen 17, and upper chimney screen 19. Due to the relatively small quantity of alcohol absorbed within outer chimney 11, only a little heat from main burner assembly 31 is required to effect vaporization. Foam ring 43 between side walls 4 of burner cup 1 and outer wall 7 functions as a layer of insulation of keep the alcohol in the outer chimney 11 from being cooled by the ambient conditions surrounding the alcohol stove. In addition, the pressure relief function of foam ring 43 causes vapors in burner cup 1 to vent through burner holes 33 rather than inner chimney 9 to prevent substantial reignition of inner chimney wick 23.

Designing inner wall 5 and outer wall 7 so that their lowest points do not touch metallic disc 3 or burner cup base 2 reduces dissipation of heat from main burner assembly 31 and inner chimney 9. Such heat dissipating would slow alcohol evaporation thereby delaying ignition of main burner assembly 31 during start-up and would cause excessive alcohol evaporation outside of outer wall 7 once steady state operation is reached.

Alcohol within burner cup 1 is cooled by metallic disc 3 which conducts the cool ambient conditions surrounding the stove to alcohol within the interior of burner cup 1 through the metallic side walls and base 2 of burner cup 1. The cooling imparted by disc 3 helps prevent run-away alcohol evaporation.

Although the invention has been described for the purpose of illustration, it is understood that such detail is solely for that purpose and variations can be made therein by those skilled in the art without departing from the spirit and scope of the invention.

What is claimed:

1. An alcohol stove comprising:

a burner cup having a base and side walls for storage of liquid alcohol;

a main burner assembly attached to said burner cup at a location where said main burner assembly will consume alcohol evaporating from within said burner cup when said main burner assembly is ignited, a top plate having upper and lower surfaces, wherein said main burner assembly is defined on the upper surface of said top plate and said burner cup is attached to the lower surface of said to place, wherein said main burner assembly comprises a perimetrical surface, defined by an inner edge and an outer edge, and openings between the inner and outer edges from which alcohol escapes;

an outer wall extending downwardly from the lower surface of said top plate in alignment with the outer edge; and an inner wall extending downwardly from the lower surface of said top plate in alignment with the inner edge, at least one screen located in said outer chimney which extends outwardly from the inner wall; and a metallic disc positioned within and near the base of said burner cup and in contact with the base or side walls of said burner cup which are also metallic for cooling said liquid alcohol in said burner cup the base and sidewalls being metallic, thereby preventing excessive alcohol evaporation and consequent uncontrolled combustion of alcohol at said main burner assembly.

2. An alcohol stove according to claim 1, further comprising:

a burner cup wick positioned in said burner cup on top of the disc.

3. An alcohol stove comprising:

a burner cup having a base and side walls for storage of liquid alcohol;

a top plate having upper and lower surfaces, said burner cup being attached to the lower surface;

a main burner assembly attached to said burner cup at a location where said main burner assembly will consume alcohol evaporating from within said burner cup when said main burner assembly is ignited, said main burner assembly being on the upper surface of said top plate and comprising a perimetrical surface, defined by an inner edge and an outer edge, and openings between the inner and outer edges from which alcohol vapor escapes;

a start-up burner assembly positioned adjacent said main burner assembly for ignition of said main burner assembly by flames from said start-up burner assembly;

heat transfer means to transfer heat from said main burner assembly and said start-up burner assembly to a quantity of alcohol held by said heat transfer means within said burner cup distal from the side walls and the base, whereby the quantity of alcohol is vaporized, said heat transfer means comprising:

(i) an inner wall extending downwardly into said burner cup from said top plate in alignment with the inner edge, wherein the inner wall defines an inner chimney where said start-up burner assembly is located;

(ii) an outer wall extending downwardly into said burner cup from said top plate in alignment with the outer edge, wherein the outer wall and the inner wall define an outer chimney; and (iii) at least one screen located in said outer chimney said at least one screen extends outwardly from the inner wall; and a fibrous wick positioned in said outer chimney, wherein the quantity of alcohol held by said heat transfer means is absorbed by said fibrous wick.

4. An alcohol stove according to claim 3, wherein said start-up burner assembly is located below said main burner assembly and within said burner cup.

5. An alcohol stove according to claim 4, wherein said start-up burner assembly comprises:

a fibrous wick located within the inner chimney and extending into said burner cup so that the fibrous wick within the inner chimney is saturated with alcohol.

6. An alcohol stove according to claim 5, wherein the start-up burner assembly further comprises:

a wick cup for carrying the fibrous wick, the wick cup being provided with a small hole to restrict the contact of alcohol with the fibrous wick.

7. An alcohol stove according to claim 3, wherein said start-up burner assembly comprises:

a fibrous wick located within said burner cup so that it is saturated with alcohol.

8. An alchol stove according to claim 3, further comprising:

inner tabs attached to the outer wall and extending inwardly toward the inner wall to maintain a desired spacing between the inner and outer walls.

9. An alcohol stove according to claim 3 further comprising:

foam ring within said burner cup and surrounding the outer wall, said foam ring being positioned and having dimensions to prevent overfilling of and excessive pressure build up within said burner cup.

10. An alcohol stove according to claim 3 further comprising:

a metallic disc positioned near the base of said burner cup and in contact with the base or side walls of said burner cup which are also metallic; and a burner cup wick in said burner cup on top of said disc.

11. An alcohol stove according to claim 3, wherein the perimeterical surface is an annular ring.

12. An alcohol stove according to claim 3, further comprising:

a fill plug inserted in a fill hole in said top plate.

13. An alcohol stove according to claim 12, further comprising:

a fill tube extending from the fill hole into said burner cup.

14. An alcohol stove comprising:

a burner cup having a base and side walls for storage of liquid alcohol;

a top plate having upper and lower surfaces, said burner cup being attached to the lower surface;

a main burner assembly attached to said burner cup at a location where said main burner assembly will consume alcohol evaporating from within said burner cup when said main burner assembly is ignited, said main burner assembly being on the upper surface of said top plate and comprising a perimetrical surface, defined by an inner and an outer edge, and openings between the inner and outer edges from which alcohol vapor escapes;

heat transfer means to transfer heat from said main burner assembly to a quantity of alcohol held by said heat transfer means within said burner cup distal from the side walls and the base, whereby the quantity of alcohol is vaporized, said heat transfer means comprising:

(i) an inner wall extending downwardly into said burner cup from said top plate in alignment with the inner edge;

(ii) an outer wall extending downwardly into said burner cup from said top plate in alignment with the outer edge, wherein the outer wall and the inner wall define a chimney; and (iii) at least one metallic screen extending radially outwardly toward the outer wall and located within the chimney; and a fibrous wick positioned in said chimney, wherein the quantity of alcohol held by said heat transfer means is absorbed by said fibrous wick.

15. An alcohol stove according to claim 14, wherein the perimetrical surface is a ring.

16. An alcohol stove according to claim 14, further comprising:

inner tabs attached to the outer wall and extending radially inwardly toward the inner wall to maintain a desired spacing between the inner and outer walls.

17. An alcohol stove according to claim 14, further comprising:

a foam ring within said burner cup and surrounding the outer wall, said foam ring being positioned and having dimensions to prevent overfilling of and excessive pressure build up within said burner cup.

18. An alcohol stove according to claim 14, further comprising:

a fill plug inserted in a fill hole in said top plate.

19. An alcohol stove according to claim 18, further comprising:

a fill tube extending from the fill hole into said burner cup.

20. An alcohol stove comprising:

a metallic burner cup having a base and side walls for storage of liquid alcohol;

a main burner assembly attached to said burner cup at a location where said main burner assembly will consume alcohol in said burner cup when said main burner assembly is ignited, wherein said main burner assembly comprises an annular ring having an inner circular edge, an outer circular edge, and openings from which alcohol vapor escapes;

a top plate having upper and lower surfaces, wherein said main burner assembly is on the upper surface of said top plate and said burner cup is attached to the lower surface of said top plate;

an outer wall extending downwardly from the lower surface of said top plate in alignment with the outer circular edge, wherein said outer wall extends to a location above the base of said burner cup;

an inner wall extending downwardly from the lower surface of said top plate in alignment with the inner circular edge, wherein said inner wall extends to a location closer to the base of said burner cup than said outer wall and wherein said inner wall and said outer wall are concentric cylinders;

a fibrous wick between said inner and outer walls;

at least one metallic screen contacting said inner wall;

a fibrous wick within said inner wall;

a wick cup for carrying said fibrous wick within said inner wall, said wick cup being provided with a small hole to restrict the contact of alcohol with the fibrous wick within said inner wall;

a foam ring within said burner cup and surrounding the outer wall, said foam ring being positioned and having dimensions to prevent overfilling of and excessive pressure build up within said burner cup;

a metallic disc positioned near the base of said burner cup and in contact with the base or side walls of said burner cup; and a burner cup wick in said burner cup on top of said disc and in contact with said inner and outer walls.

* * * * *